US010488137B1

(12) United States Patent
Dean

(10) Patent No.: US 10,488,137 B1
(45) Date of Patent: Nov. 26, 2019

(54) DOUBLE HELIX MONOCORE FIREARM SOUND SUPPRESSOR

(71) Applicant: Steven M. Dean, Munford, AL (US)

(72) Inventor: Steven M. Dean, Munford, AL (US)

( * ) Notice: Subject to any disclaimer, the term of this patent is extended or adjusted under 35 U.S.C. 154(b) by 376 days.

(21) Appl. No.: 15/665,233

(22) Filed: Jul. 31, 2017

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS 1,003,531 A * 9/1911 Smoot ..... F01N 1/12 181/280
1,021,742 A * 3/1912 Moore ..... F41A 21/30 181/223
1,341,363 A * 5/1920 Fiala ..... F41A 21/30 181/223
1,770,471 A * 7/1930 Hatcher ..... F41A 21/30 89/14.3
2,216,653 A * 10/1940 Urban Sauer ..... F01N 1/08 181/262
2,792,760 A * 5/1957 Hammer ..... F41A 21/34 89/14.2
4,685,534 A * 8/1987 Burstein ..... F01N 1/00 181/223
5,136,923 A 8/1992 Walsh, Jr.
6,722,254 B1 4/2004 Davies
8,978,818 B2 3/2015 Proske
9,086,248 B2 7/2015 Young et al.
D741,443 S 10/2015 Cheney
9,599,421 B1 3/2017 Dean
9,851,166 B2 * 12/2017 Petersen ..... F41A 21/30
2014/0216237 A1 * 8/2014 Butler ..... F41A 21/36 89/14.4
2017/0102202 A1 * 4/2017 Augustine ..... F41A 21/30
2018/0328689 A1 * 11/2018 Wilson ..... F41A 21/30
2018/0347932 A1 * 12/2018 Bray ..... F41A 21/34
2018/0356173 A1 * 12/2018 Dome ..... F41A 21/30
2019/0072353 A1 * 3/2019 Slack ..... F41A 21/30

* cited by examiner

*Primary Examiner* — Jeremy A Luks
(74) *Attorney, Agent, or Firm* — Lanier Ford Shaver & Payne, PC; Gerald M. Walsh

(57) ABSTRACT

A double helix firearm sound suppressor having a front portion with a front chamber, a rear portion with a rear chamber, and a hollow central core in the front chamber. Hollow projections extend from the hollow central core into the front chamber, wherein interiors of the hollow projections communicate with an interior of said hollow central core. The hollow projections form one or more helical pathways for propellant gases in one direction around the hollow central core and form one or more helical pathways for propellant gases in an opposite direction around the hollow central core. Openings in the hollow projections allow propellant gases to flow from the interior of the central core into the front chamber. The double helix configuration greatly increases the surface area for dissipating and suppressing sound.

7 Claims, 4 Drawing Sheets

DOUBLE HELIX MONOCORE FIREARM SOUND SUPPRESSOR

FIELD OF THE INVENTION

This invention relates to sound suppressors for a firearm and, more particularly, to a monocore firearm sound suppressor having a double helix structure which produces a double helical formation of the flow of propellant gases along the longitudinal axis of a central channel and directs the gases into a plurality of helically oriented chambers external to the central channel.

BACKGROUND OF THE INVENTION

Firearm sound suppressors work by trapping and delaying the exit of the high pressure muzzle gases from a firearm when the firearm is discharged. Creation of turbulence is one technique used to enhance the trapping of the gases with a subsequent delay in the exit of the gases from a sound suppressor. If a sound suppressor is very effective at trapping and delaying the exit of the gases, this results in a lower sound level coming from the firearm.

Firearm sound suppressors usually feature either use of discrete or individual components or a monolithic construction where the main structure is of one piece. Monolithic construction of a sound suppressor can be performed with computer numerically controlled (CNC) machinery to produce a one-piece core, referred to as a monocore, that has the baffle structure machined from one piece of metal. Sound suppressors that have a monocore with baffles are disclosed in U.S. Pat. Nos. 8,978,818 and 9,086,248.

U.S. Pat. No. 5,136,923 discloses a firearm silencer which includes an outer housing and an interior tube (a central channel) within the housing. The interior tube is spaced from the inside walls of the housing to form an exterior chamber around the interior tube. The interior tube is adapted to receive a projectile discharged from a firearm and extends the entire length of the housing which is attached to a muzzle of a firearm. The interior tube is perforated with a plurality of rows of ports which extend through the wall of the interior tube and discharge into the exterior chamber. The sound suppressing performance of this type of suppressor is considered to be due to the rapid heat exchange between the propellant gases and the surface area of the conductive metal in the suppressor. The efficiency of this type silencer is considered greater on a volume basis for a given projectile clearance than that of baffle silencers. However, because of the limited surface area inherent in this type of design, this type of suppressor is useful only for small fire arms. A sound suppressor of this design having substantially increased surface area for a given volume, for heat dissipation, and that could create greater turbulance of the gases around the length of the interior tube, would be much more effective in suppressing sound and attenuating recoil.

U.S. Pat. No. 9,599,421 improved on the design disclosed in U.S. Pat. No. 5,136,923 by providing a central channel having a circular central bore, through which a projectile passes, and a rectangular external shape with four sides with openings thereon. Each side rotates 60 to 120 degrees around the longitudinal axis of the central bore, forming a helical twist in the central channel. Chambers extend from the central channel and form the same helical configuration as the central channel, producing a helical flow of propellant gases, coming out of the central channel, from a rear end to a front end of the central channel. This design improves sound suppression and accuracy of the firearm.

A double helix configuration of a sound suppressor may further improve sound suppression and accuracy of a firearm but heretofore has not been available.

SUMMARY OF THE INVENTION

This invention is a double helix firearm sound suppressor having a front portion with a front chamber, a rear portion with a rear chamber, and a hollow central core in the front chamber. Hollow projections extend from the hollow central core into the front chamber, wherein interiors of the hollow projections communicate with an interior of the hollow central core. The hollow projections are arranged around the hollow central core to form one or more helixes in one direction around the hollow central core and to form one or more helixes in an opposite direction around the hollow central core. The hollow projections form one or more helical pathways for propellant gases in one direction around the hollow central core and form one or more helical pathways for propellant gases in an opposite direction around the hollow central core. Openings in the hollow projections allow propellant gases to flow from an interior of the central core into the front chamber.

The sound suppressor has a first end, forming a front end of the front portion, and a second opposite end, forming a rear end of the rear portion, wherein a rear end of the front portion is adjacent to a front end of the rear portion. The rear portion has a plurality of connecting arms extending from the rear end of the rear portion to the rear end of the front portion. The sound suppressor has a baffle extending from the rear end of the front portion into the rear chamber of the rear portion. The baffle has a nozzle to guide propellant gas into the hollow central core and propellant gas flow guides to guide propellant gas into the helical pathways. The hollow projections and the helical pathways extend from the rear end of the front portion to the front end of the front portion and make a rotation of 180 degrees to 270 degrees about the hollow central core. The sound suppressor can be manufactured from a single piece of metal.

The double helix configuration of the present invention greatly increases the surface area for dissipating and suppressing sound compared to existing sound suppressors and consequently, provides a remarkably improved sound suppressor.

An advantage of the sound suppressor of the present invention is a single piece double helix monocore.

Another advantage are helical pathways that direct propellant gases in one direction around the central core and in an opposite direction around the central core.

Another advantage is a baffle with a nozzle, wherein the baffle directs propellant gases into the hollow interior of the central core and into the helical pathways around the central core.

Another advantage are openings in the central core which direct propellant gases into the hollow projections that extend from the central core.

Another advantage is that essentially, all propellant gases remain behind the projectile as it exits from the sound suppressor.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
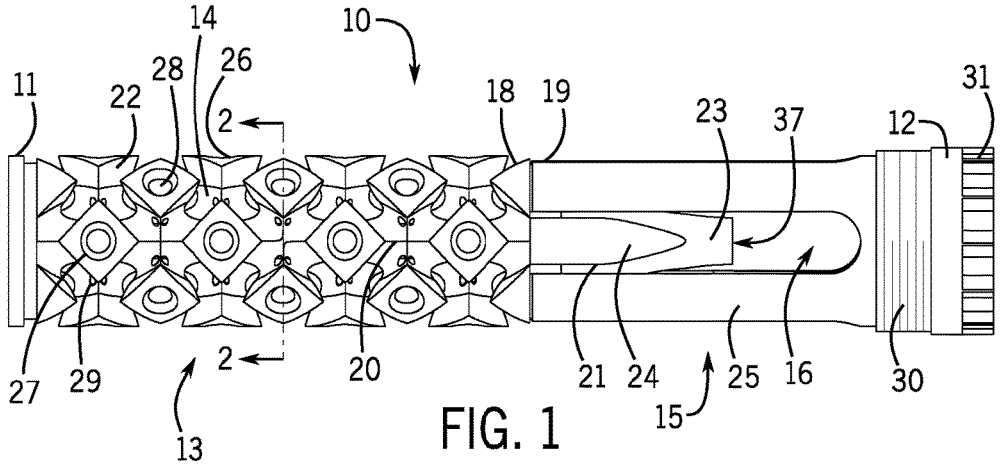
FIG. 1 is a side view of the double helix monocore firearm sound suppressor of the present invention.

FIG. 1 shows a side view of the double helix monocore firearm sound suppressor 10 of the present invention. The sound suppressor 10 has a first end 11 and a second opposite end 12 and consists of a front portion 13, having a front chamber 14, and a rear portion 15, having a rear chamber 16. The first end 11 forms a front end of the front portion 13 and the second opposite end 12 forms a rear end of the rear portion 15. A rear end 18 of the front portion 13 is adjacent to a front end 19 of the rear portion 15. A hollow central core 20 is positioned in the center of the front portion 13 and a baffle 21 is positioned in the rear portion 15 and extends from the rear end 18 of the front portion 13 into rear chamber 16 of the rear portion 15. Hollow projections 22 extend from the hollow central core 20 and extend into the front chamber 14. Baffle 21 has a nozzle 23 and propellant gas flow guides 24. The rear portion 15 has connecting arms 25 extending from the rear end of second opposite end 12 to the rear end 18 front portion 13. The hollow projections 22 have a top end 26 with an opening 27 into an interior 28 and side openings 29 into interior 28. Second opposite end 12 has a threaded portion 30 and a portion with external splines 31 for attachment of a case 36 (see FIG. 2) which encases the front portion 13 and the rear portion 14 of the sound suppressor 10.

Figure 2:
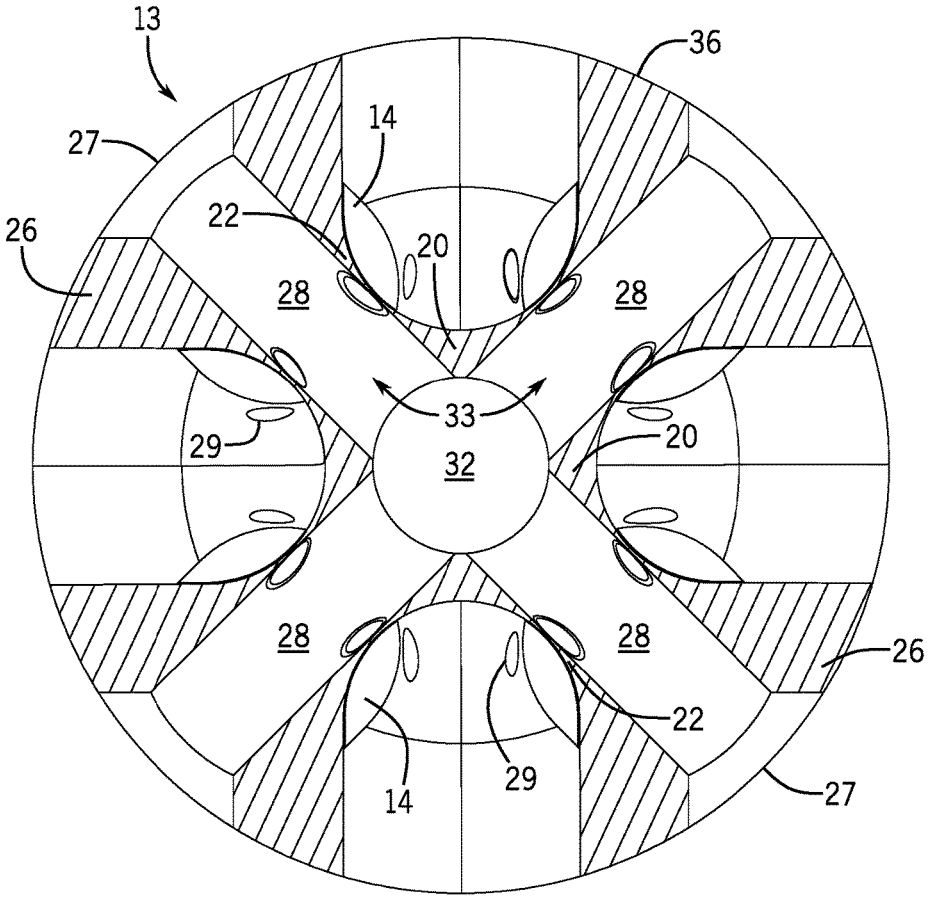
FIG. 2 is a sectional view through the front portion of the sound suppressor along line 2-2 of FIG. 1.

FIG. 2 shows a sectional view through the front portion 13 of the sound suppressor 10 along line 2-2 of FIG. 1. FIG. 2 further shows the interior 32 of the hollow central core 20 and openings 33 from the hollow central core 20 into the interior 28 of the hollow projections 22.

Figure 3:
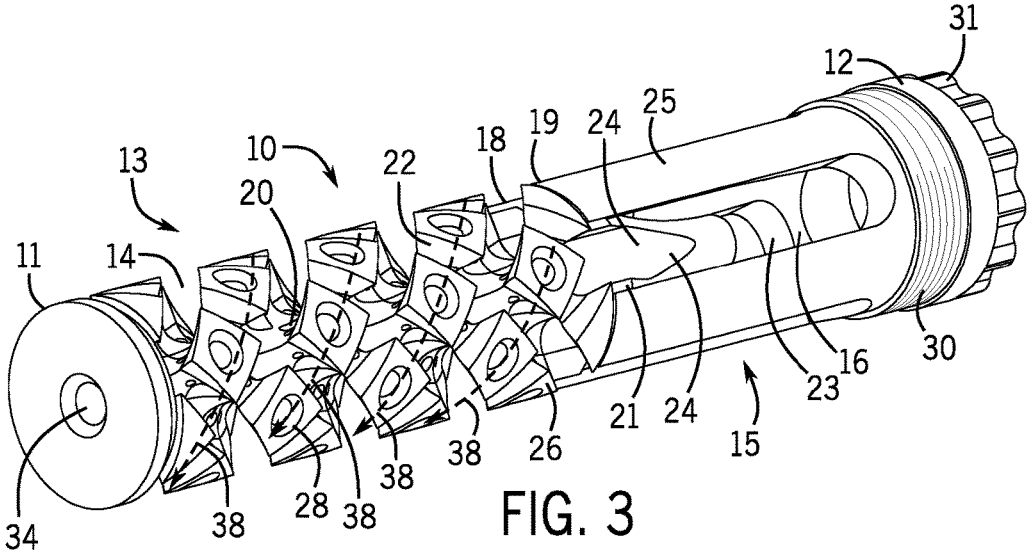
FIG. 3 is a front, side, perspective view of the sound suppressor showing four series of hollow projections winding around a central core of the sound suppressor in one direction forming helixes.

FIG. 3 is a front, side, perspective view of the sound suppressor 10 showing four series of hollow projections 22 winding around the central core 20 of the sound suppressor 10 in one direction forming helixes. Each series is shown by a dashed line 38. FIG. 3 further shows a central opening 34 in the first end 11.

Figure 4:
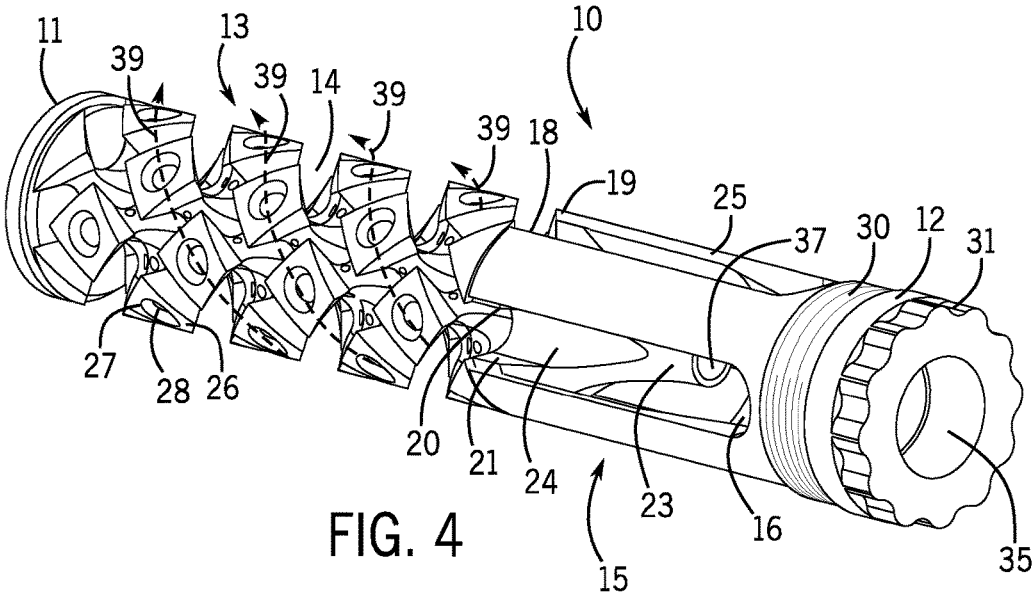
FIG. 4 is a rear, side, perspective view of the sound suppressor showing four series of hollow projections winding around a central core of the sound suppressor in an opposite direction forming helixes.

FIG. 4 is a rear, side, perspective view of the sound suppressor 10 showing four series of hollow projections 22 winding around the central core 20 of the sound suppressor 10 in an opposite direction forming helixes. Each series is shown by a dashed line 39. FIG. 4 further shows a central opening 35 in the second opposite end 12 and an opening 37 in the nozzle 23.

Figure 5:
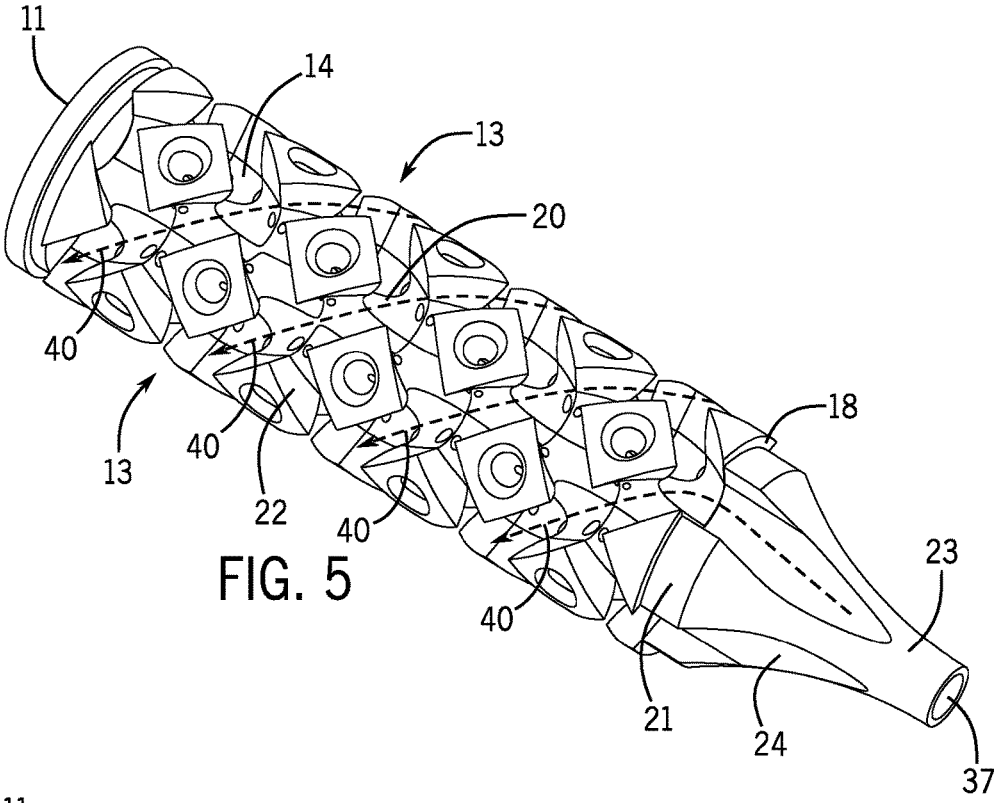
FIG. 5 is a top, front, perspective view of a front portion of the sound suppressor showing four series of propellant gas pathways winding around a central core of the sound suppressor in one direction forming vortices of propellant gases.

FIG. 5 is a top, front, perspective view of the front portion 13 of the sound suppressor 10 showing four series of helical propellant gas pathways 40 winding around the central core 20 of the sound suppressor 10 in one direction forming vortices of propellant gases. The pathways 40 are formed in spaces of the front chamber 14 between the hollow projections 22.

Figure 6:
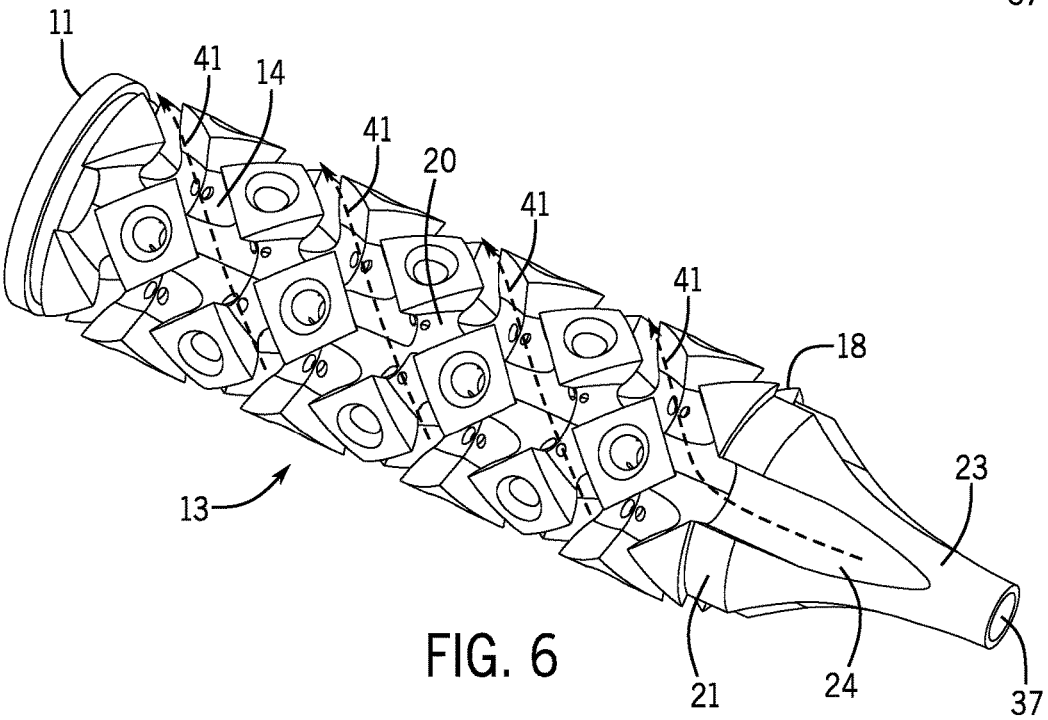
FIG. 6 is a top, front, perspective view of the front portion of the sound suppressor showing four series of propellant gas pathways winding around a central core of the sound suppressor in an opposite direction forming vortices of propellant gases.

FIG. 6 is a top, front, perspective view of the front portion 13 of the sound suppressor 10 showing four series of helical propellant gas pathways 41 winding around a central core 20 of the sound suppressor 10 in an opposite direction, also forming vortices of propellant gases in the spaces of the front chamber 14 between the hollow projections 22. The series of helical hollow projections 38, 39 and the helical pathways 40, 41 extend from the rear end 18 of the front portion 13 to the first end 11 of the front portion 13 and make a rotation of 180 degrees to 270 degrees about the hollow central 20 core up to the first end 11.

Figure 7:
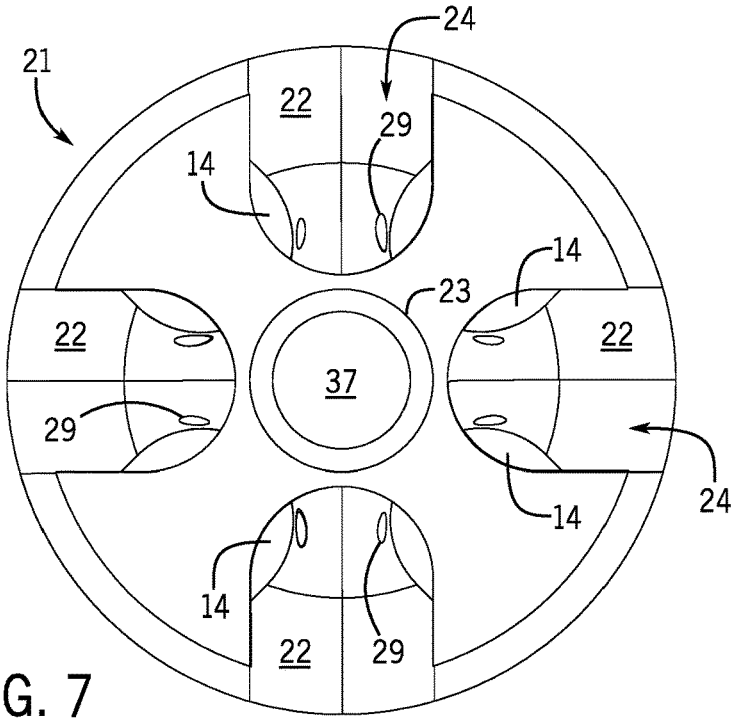
FIG. 7 is a rear end view of a baffle with a nozzle in the sound suppressor.
Figure 8:
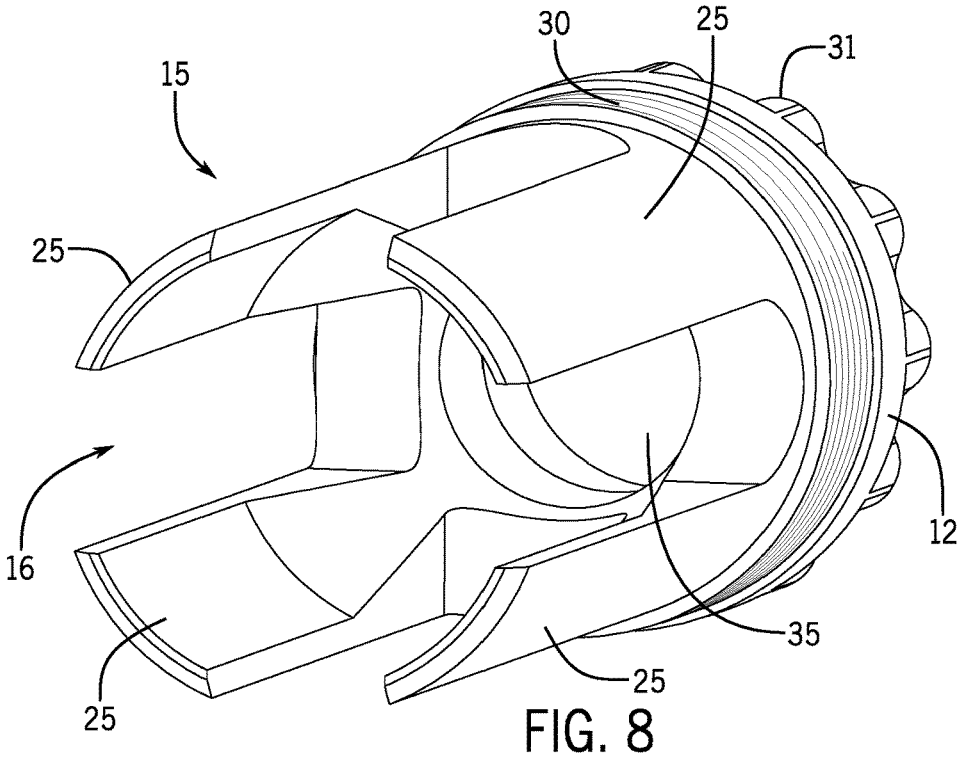
FIG. 8 is a front, side, perspective view of a rear portion of the sound suppressor.

FIG. 7 is a rear end view of the baffle 21 showing a rear end of the nozzle 23. FIG. 8 is a front, side, perspective view of the rear portion 15 of the sound suppressor 10.

When the sound suppressor 10 is attached to the barrel of a firearm and a round is fired, the propellant gases exit the barrel of the fire arm and enter the rear chamber 16 of the sound suppressor 10. The gases then enter the nozzle 23 through its opening 37 and flow along the propellant flow guides 24 on baffle 21. Gases that enter the nozzle 23 pass into the interior 32 of the central core 20. The gases can then pass into the interior 28 the hollow projections 22 through opening 33 in the central core 20. Any gases that pass out the opening 27 at the end 26 of the hollow projections 22 can enter the front chamber 14 of the front portion 13 of the sound suppressor 10. Gases in the interior 28 of the hollow projections 22 can pass into the front chamber 14 through openings 29 and gases in the front chamber 14 can enter the interior 28 of the hollow projections 22 through openings 29. Gases that flow along the propellant flow guides 24 will enter the helical pathways 40 in the front chamber 14 in one direction and will enter the helical pathways 41 in the front chamber 14 an opposite direction. The propellant gases ultimately pass along the interior 32 of the central core 20 and pass out of the sound suppressor 10 through central opening 34 at the front end 11.

The double helix configuration of the present invention greatly increases the surface area for dissipating and suppressing sound compared to existing sound suppressors and consequently, provides a remarkably improved sound suppressor. The movement of gases into the support chambers contributes further to the improved effectiveness of the double helix sound suppressor. Essentially, all propellant gases remain behind the projectile as it exits from the sound suppressor.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the sound suppressor can have any desired length or diameter and can be made of any desired metal. The sound suppressor can be made as a monocore sound suppressor or the components can be made individually and assembled to form the sound suppressor. The sound suppressor can have as many hollow projections and helical pathways as desired. The openings in the central core and the hollow projections can have any desired shape.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A double helix firearm sound suppressor, comprising:

a) a front portion having a front chamber, a rear portion having a rear chamber, and a hollow central core in said front chamber;

b) hollow projections extending from said hollow central core into said front chamber, wherein interiors of said hollow projections communicate with an interior of said hollow central core;

c) said hollow projections arranged around said hollow central core to form one or more helixes in one direction around said hollow central core and to form one or more helixes in an opposite direction around said hollow central core;

d) said hollow projections forming one or more helical pathways for propellant gases in one direction around said hollow central core and forming one or more helical pathways for propellant gases in an opposite direction around said hollow central core; and e) openings in said hollow projections to allow propellant gases to flow from the interior of said hollow central core into said front chamber.

2. The sound suppressor of claim 1, further comprising said sound suppressor having a first end, forming a front end of said front portion, and a second opposite end, forming a rear end of said rear portion, wherein a rear end of said front portion is adjacent to a front end of said rear portion.

3. The sound suppressor of claim 2, further comprising said rear portion having a plurality of connecting arms extending from said rear end of said rear portion to said rear end of said front portion.

4. The sound suppressor of claim 1, further comprising a baffle extending from said rear end of said front portion into said rear chamber of said rear portion.

5. The sound suppressor of claim 4, further comprising said baffle having a nozzle to guide propellant gas into said hollow central core and propellant gas flow guides to guide propellant gas into said helical pathways.

6. The sound suppressor of claim 2, wherein said hollow projections and said helical pathways extend from said rear end of said front portion to said front end of said front portion and make a rotation of 180 degrees to 270 degrees about said hollow central core.

7. The sound suppressor of claim 1, wherein said sound suppressor is manufactured from a single piece of metal.

* * * * *